United States Patent [19]

Jones

[11] Patent Number: 4,775,358

[45] Date of Patent: Oct. 4, 1988

[54] MACHINE FOR MAKING PAPER BOOKLETS

[75] Inventor: Stanley G. Jones, Rhiwbina, Wales

[73] Assignee: Rizla Limited, Mid-Morgan, Wales

[21] Appl. No.: 24,162

[22] Filed: Mar. 10, 1987

Related U.S. Application Data

[63] Continuation-in-part of Ser. No. 745,128, Jun. 17, 1985, Pat. No. 4,648,862.

[51] Int. Cl.[4] ..... B65H 45/22; B65H 45/24; B65H 45/28; B26D 1/60

[52] U.S. Cl. ..... 493/346; 493/357; 493/369; 493/372; 83/160; 83/320; 270/40

[58] Field of Search ..... 83/158, 159, 160, 318, 83/319, 320; 270/40; 493/346, 357, 369, 372, 472

[56] References Cited

U.S. PATENT DOCUMENTS

| | | | |
|---|---|---|---|
| 2,414,906 | 1/1947 | Seltzer | 83/320 |
| 2,514,611 | 7/1950 | Smith | 83/158 |
| 2,569,197 | 9/1951 | Royer | 83/159 |
| 3,368,435 | 2/1968 | Bastable | 83/139 |
| 3,686,989 | 8/1972 | Dreher | 83/320 |
| 3,726,168 | 4/1973 | Glanz et al. | 83/158 |
| 3,960,023 | 6/1976 | Gralinski | 83/160 |
| 4,290,592 | 9/1981 | Kastner | 83/320 |
| 4,335,635 | 6/1982 | Hautemont | 83/160 |
| 4,361,064 | 11/1982 | Sasaki . | |

*Primary Examiner*—Frederick R. Schmidt
*Assistant Examiner*—William E. Terrell
*Attorney, Agent, or Firm*—Marks Murase & White

[57] ABSTRACT

In a multi-bobbin machine for making paper booklets e.g. of interleaved cigarette paper, a multiplicity of strips from respective supply bobbins are interfolded and converged to form a booklet strand which is cut to length by a cutting station which reciprocates along the strand so that booklet lengths enter it and are cut. A rotating non-circular shaft passes through the cutting station and a sleeve in the cutting station slides axially along the shaft as the station reciprocates and rotates with the shaft. The sleeve is independently linked to a strand clamp and to a cutting knife which are separately timed and move along different paths, the strand clamp moving longitudinally towards and away from the strand whilst the knife makes a slicing movement across and through the strand. A fixed ejector driven by a second sleeve on the shaft ejects booklets from the cutting station into a discharge chute, the ejector being preferably driven by a pair of cams so that in its return stroke it passes above the strand advancing into the cutting station. With this arrangement the ejector can be as wide as the discharge chute and is not difficult to time.

15 Claims, 17 Drawing Sheets

212
216
208
205
202
76
204
207
211
215
203
213
209
201
214
79
32

MACHINE FOR MAKING PAPER BOOKLETS

This application is a continuation-in-part of my U.S. patent application Ser. No. 745,128 filed June 17, 1985, now U.S. Pat. No. 4,648,862 of Mar. 10, 1987.

FIELD OF THE INVENTION

This invention relates to a machine for making paper booklets which is particularly, though not exclusively, intended for making booklets of interleaved cigarette paper.

BACKGROUND TO THE INVENTION

Apparatus is provided in which booklets of interleaved cigarette papers can be made from continuously moving strands of strip paper in which a cutting knife used to sever the paper strips precisely follows movement of the strip. Movement of a driven input shaft is brought onto the moving platform and used to operate the cutting knife. Paper from bobbins is converged by formers and a spreader into a strand advanced by nip rolls through a cutting station. The knife in the station cuts a booklet from the strand while the station moves with the strand. A driven rotary shaft of non-circular section transmits its rotation to a sleeve that slides therealong as the station reciprocates relative to a shaft. The sleeve is operably connected e.g. by gearing or by a cam and follower to the knife so that rotation thereof brings about the cutting movement.

It is known from Patent Specification No. GB-A No. 688144 (Korber) to make booklets of folded and zig-zag interleaved cigarette papers by withdrawing paper strip from a plurality of supply rolls or bobbins, folding and interleaving the strips by passage through a succession of combs to form a folded and interleaved strand, and cutting the strand to form booklets. But the machine employed by Korber had a stationary cutting knife which was impractical for high speed operation and did not make a clean transverse cut through the strand which is required to move continuously. U.K. Pat. No. 2165080 (Kastner) describes a similar machine in which the paper is cut by a movable or "flying" cutting station. The knife is mounted on a movable knife plate carried by a platform that is reciprocally movable in a direction parallel to the direction of travel of the strand of interleaved paper strips. A cylinder or other means carried by the platform reciprocally moves the knife plate towards or away from the strand so that the knife follows the movement of the strand as it severs the strip. A pusher plate carried by and movable with the knife plate displaces a severed booklet or packet sideways with respect to the line of travel of the strand. But the Kastner machine still presents a number of disadvantages. Reciprocation of the platform is by an eccentric on a drive wheel that is coupled to the platform by a pivoted link, so that the platform does not match the speed of the strand throughout its rearward stroke, but instead its velocity varies in simple harmonic motion. Since the knife is moved towards and away from the strand without any component of motion across it, cutting is not as efficient as it could be. Cut booklets are discharged sideways into a magazine which is joined to the reciprocating platform by means of a flexible portion, which is essential because movement of the pusher is not separated from that of the knife. A flying cutting station is also suggested in German Patent Specification No. 427701 (Maschinefabrik Munchen). Such a device is known in the context of severing tobacco rod from, e.g. U.S. Pat. No. 3,686,989 (Drehr).

Our U.S. Pat. No. 4,648,862 of Mar. 10, 1987 describes and claims apparatus as aforesaid in which a rotatory movement of the cutting station drive is brought onto the moving "platform" of the cutting station and used to operate the cutting knife. Thus rotation of a driven member in the cutting station could be transmitted to the knife by means of a cam and follower, by means of gearing or by means of a chain or belt. The knife was driven positively from the same drive that reciprocated the cutting station, and a desirable guillotine-like or slicing cutting action was achieved. An ejector was also mounted on the cutting station as also was a clamping device, and bringing of rotatory movement to the cutting station enabled these additional functions to be independently coupled to the rotating shaft to perform differently timed operations along independent paths. Cut booklets were fed to a discharge chute having an inlet spring providing a ratchet-like function so that cut booklets once in the chute did not return.

SUMMARY OF THE INVENTION

It is an object of the invention to provide apparatus for forming booklets from continuously moving strands of paper strips in which the cutting knife precisely follows the movement of the strip, provision can be made for clamping the strand before it is cut and for ejecting the cut booklets, and the clamping, cutting and ejection operations may be timed independently in accordance with the position of the knife to bring about the desired results.

The solution adopted by the applicants is to bring the rotatory movement onto the moving "platform" or cutting station and to use that movement to operate the cutting knife. Thus rotation of a driven member in the cutting station may be transmitted to the knife by means of a cam and follower, by means of gearing or by means of a chain or belt. The knife can be driven positively from the same drive that reciprocates the cutting station, and the desirable guillotine-like cutting action may be achieved.

Broadly stated the invention provides a machine for performing an operation on a paper strand including means for forming leaves of paper into a strand, a station in the path of the strand, means in the station for performing an operation on the strand, drive means for continuously advancing the strand through the station and for reciprocating the station along the strand so that a booklet length of the strand enters the station while the station moves counter to the strand, and drive transfer means operatively connecting said drive means to the means in the station so that the operation is performed while the station moves with the strand.

More specifically the invention provides a machine for forming booklets of paper comprising:

a paper supply in the form of a plurality of rolls of strip paper from which strip may be continuously withdrawn;

means for converging paper strips withdrawn from the several supply rolls to form a single strand;

means for advancing the strand;

a cutting station through which the strand is advanced and supported for reciprocal movement along the strand so that a booklet length of the strand enters the station while the station moves counter to the strand;

a knife in the cutting station arranged to cut a booklet from the strand in the station while the station moves with the strand; and a rotating shaft of non-circular cross-section that passes through the station and through a sleeve therein that slides along the shaft as the station reciprocates and is rotated by the shaft, the sleeve being operably connected to the knife so that rotation thereof brings about the cutting movement.

A feature of apparatus in U.S. Pat. No. 4,648,862 that is also present in modified apparatus described hereinafter is that the cutting station has strand claimping means and knife means that are independently linked to the rotating shaft so that they can be independently timed and can move along different paths.

In one aspect, therefore, the invention provides a machine for forming booklets of paper, comprising: a plurality of roller means for continuously providing strips of paper; former means for converging paper strips withdrawn from said roller means into a single strand; means for advancing the strand in a first direction; a cutting station for reciprocably moving along the strand whereby a booklet length of the strand enters said cutting station while said cutting station moves counter to the strand in a second direction opposite to the first direction; a rotating shaft of non-circular cross-section extending through the cutting station, and directed parallel to said first direction; a clamping means disposed in said cutting station for clamping the strand at the upstream end of the cutting station while the cutting station moves alongside the strand in the first direction; knife means disposed in the cutting station for cutting a booklet from the strand while said cutting station moves alongside the strand in the first direction; a tubular sleeve slideably mounted on said shaft and operably connected to the cutting station, reciprocal movement of said cutting station causing said sleeve to slide in an axial direction along said shaft and rotation of said shaft causing said sleeve to rotate; a clamp coupling means for coupling said clamping means to said sleeve and comprising a linking means for translating rotational movement of said sleeve into longitudinal movement of said clamping means; and a knife coupling means for coupling said knife means to said rotating sleeve, said knife coupling means comprising gear train means for translating rotational movement of said sleeve into a rotational slicing movement of said knife means across the strand in a plane substantially perpendicular to said first direction.

The invention of U.S. Pat. No. 4,648,862 operates as described, but it has a number of features that render extended continuous periods of operation difficult to achieve. Cut booklets could incompletely engage into the discharge chute so that operation had to be stopped until the misplaced booklet or booklets were cleared. The eject operation had to be carried out in a small part of the machine cycle, requiring a rapid movement of the ejector that was difficult to achieve and demanded great accuracy in setting up.

The present invention also achieves extended continuous operation. This is achieved by separating the ejector from the cutting station and relocating it to a fixed position opposite to the discharge chute and by coupling the ejector to the cutting station so that both operate in correct timed relationship in each machine cycle.

The invention therefore further provides a machine for forming booklets of paper, comprising a plurality of sources of paper strip, forming means for converging paper strips from the several sources into a single strand, means for advancing the strand in a first direction, a cutting station for reciprocably moving along the strand whereby a booklet length of the strand enters the cutting station while the cutting station moves counter to the strand in a second direction opposite to the first direction, an ejector means for ejecting booklets from said cutting station into a fixed outlet passage said ejector means also being fixed and receiving booklets from the cutting station when the cutting station is towards the end of its travel in the first direction, and means defining a coupling between the cutting station and the ejector means so that the ejector means operates in a predetermined timed manner in each reciprocation of the cutting station.

DESCRIPTION OF PREFERRED FEATURES

The rolls of paper may be supported in a crescent shaped single unit bobbin stand or frame including posts to either side of each roll by means of stub axles on the bobbin carriers that are received in slots in the posts. Desirably the posts between adjacent rolls are common and the slots for the axles of different rolls are at different levels whereby the axles do not interfere with one another and one roll may be changed without disturbing the adjacent roll or rolls. The rolls may be arranged in upper and lower banks and the paper strips may be fed to converging means over guide rollers that deflect them to a generally horizontal line of travel.

The converging means preferably comprises a primary folding comb adjacent the rolls that folds the strips, a spreader comb that facilitates the first stage of interleaving, a secondary folding comb that substantially defines the interfolded shape of the strips, and a final forming comb that determines the height of the interleaved strand.

The outlet passage will normally have ratchet spring means at its entrance acting on the booklets entering the passage to prevent them returning to the ejector, and the ejector has thrust plate means extending substantially the full width of the outlet passage.

Very advantageously the ejector means is operated by a first coupling means on a rotating shaft providing a forward and reverse movement and by a second coupling means on the rotating shaft providing a rise and fall movement so that the ejector means advances in the direction of the outlet passage, rises above the path of the strand and then returns. With this arrangement the thrust plate can occupy substantially the full width of the discharge chute, not leaving the upstream end unsupported and prone to deflect as it passes the ratchet spring means which is a major cause of booklet misengagement. The reason why the thrust plate can be made full width is that on the return stroke it rises above the incoming booklet strand.

The machine preferably includes a wall leading to the outlet passage, first and second links pivoted to the wall for rotation in a plane generally parallel to the outlet passage, a third link connecting the first and second links to form a parallelogram linkage, the first link being relatively short and nearer the outlet passage a first cam on the rotating shaft being coupled to the first link by means including a follower at the end of the first link to effect the forward and reverse movement, the second link being relatively long and having pivoted thereto a fourth link carrying a thrust plate at its tip, a second cam on the rotating shaft being coupled to the second link by means including a follower partway along the second link to effect the rise and fall movement. Advantageously the thrust plate is bifurcated to define a pair of vertically spaced tines facing the cutting station, and the cutting station has a paper guide that passes between the tines as the cutting station completes its travel in the first direction, said paper guide defining a linear path for paper strand past the cutting station.

A rotating shaft of non-circular cross-section advantageously extends through said cutting station parallel to the first direction and is operably connected to the cutting station, a knife means responsive to rotation of the rotating shaft is disposed in the cutting station for cutting a booklet from the strand which the cutting station moves alongside the strand in a first direction, and knife couplng means translates rotational movement of the rotating shaft into rotational slicing movement of said knife means across the strand in a plane substantially perpendicular to the first direction, the path of the knife means and the path of the ejector being mutually independent. A strand clamping member may be disposed on the cutting station and disengaging cam means disposed on the tubular sleeve disengages the clamping member when the cutting station is moving in the second direction. The cutting station is preferably coupled to its reciprocating drive via a constant velocity cam arrangement.

The converging means preferably comprises a primary folding comb adjacent the rolls that folds the strips, a spreader comb that facilitates the first stage of interleaving, a secondary folding comb that substantially defines the interfolded shape of the strips, and a final forming comb that determines the height of the interleaved strand.

BRIEF DESCRIPTION OF THE DRAWINGS

Various embodiments of the invention will now be described with reference to the accompanying drawings, in which.

DETAILED DESCRIPTION OF PREFERRED EMBODIMENT

Figure 1:
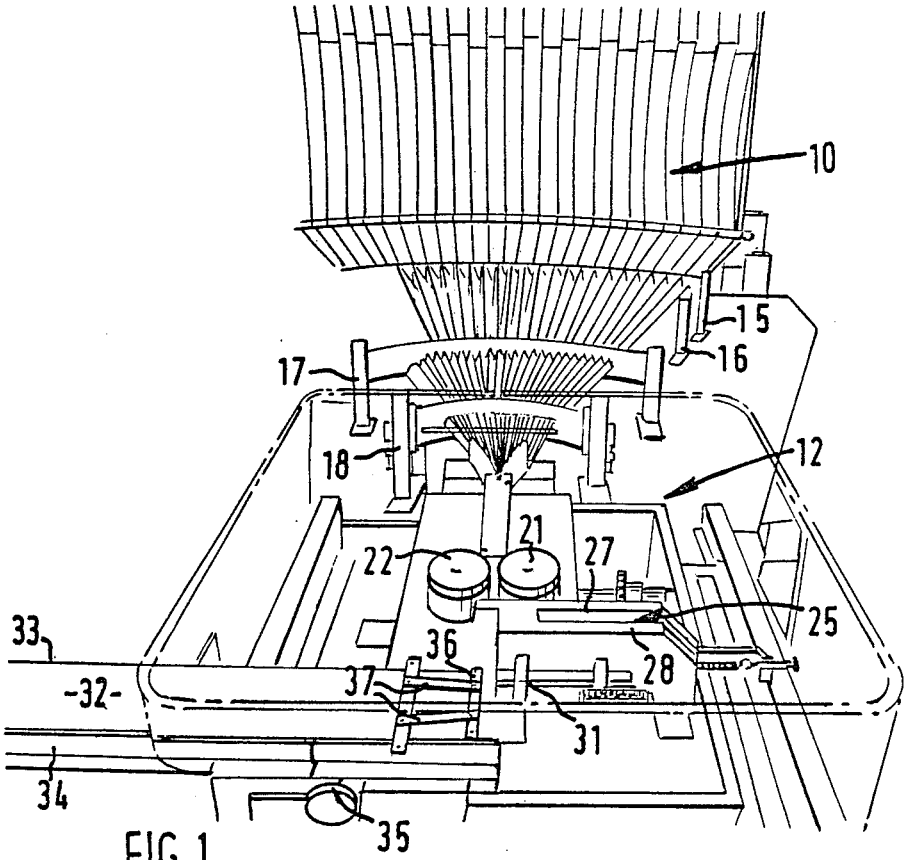
FIG. 1 is an end view of a folding and interleaving machine according to U.S. Pat. No. 4648862.

In the drawings, there is shown a machine for folding and interleaving fifty sheets of cigarette paper into a so-called booklet, each booklet being separated from adjacent booklets by a strip of cardboard or the like separating material. There are therefore fifty paper strips and a single cardboard strip that have to be fed into the machine from the same number of bobbins. These bobbins 10, 11 are arranged in two arcuate rows one above the other and in such a manner that the bobbins 10 in the upper row are in staggered relation to the bobbins 11 in the lower row. The arcs of the bobbins 10, 11 are struck from a centre coinciding with the point of covergence of the eventual interleaved paper strip as they enter a drive and cutting unit generally indicated by the reference numeral 12. The paper leaving bobbins 10, 11 is deflected into a generally horizontal path by upper and lower sets of guide rollers 13, 14 and passes to a first former 15 that is arcuate in plan with its centre coinciding with that of the bobbin arc which folds the several strips. The strips pass from the former 15 to a spreading comb 16 that is also arcuate in plan, the purpose of the spreading comb being to spread out and align the folded strips in order to facilitate the first step of interleaving. The paper passes from comb 16 to a second former 17 which substantially defines the interfolded shape of the sheets and thence to a final former 18 that serves to bring the interleaving to its final stage and to determine the height of the interleaved booklets. From the former 18 the interleaved strips converge at the inlet to a pair of parallel guides 19, 20 shown in FIG. 3, defining a channel along which the resulting interleaved strand is conveyed and at which the leaves are compressed to form a flat strand for cutting into booklets.

Interleaved booklet strand from the guide channel passes between a pair of knurled drive or pull-through rollers 21, 22 both of which are driven through gearing (described below) at a proper surface speed. The roller 22 is reciprocable transversely and is spring loaded into engagement with the advancing strand. The purpose of this arrangement is to maintain a proper pressure on the strand and to compensate for any variation in paper thickness. The spring loading enables even a single leaf of paper to be pinched and pulled through, thus simplifying thread up of the complete machine. In earlier machines where the drive or pull through rollers had fixed centres, these were not effective until all the leaves were present between the rollers. It is important that positive drive on the booklet strand should be maintained and that no slippage between the strand and the rollers 21, 22 should occur, otherwise there will be an irregularity in the length of the cut booklets. The booklet strand leaving the rollers 21, 22 passes through a further pair of parallel guides 23, 24 which maintain the strand in its compressed state and stop the advancing strand from buckling.

Figure 3:
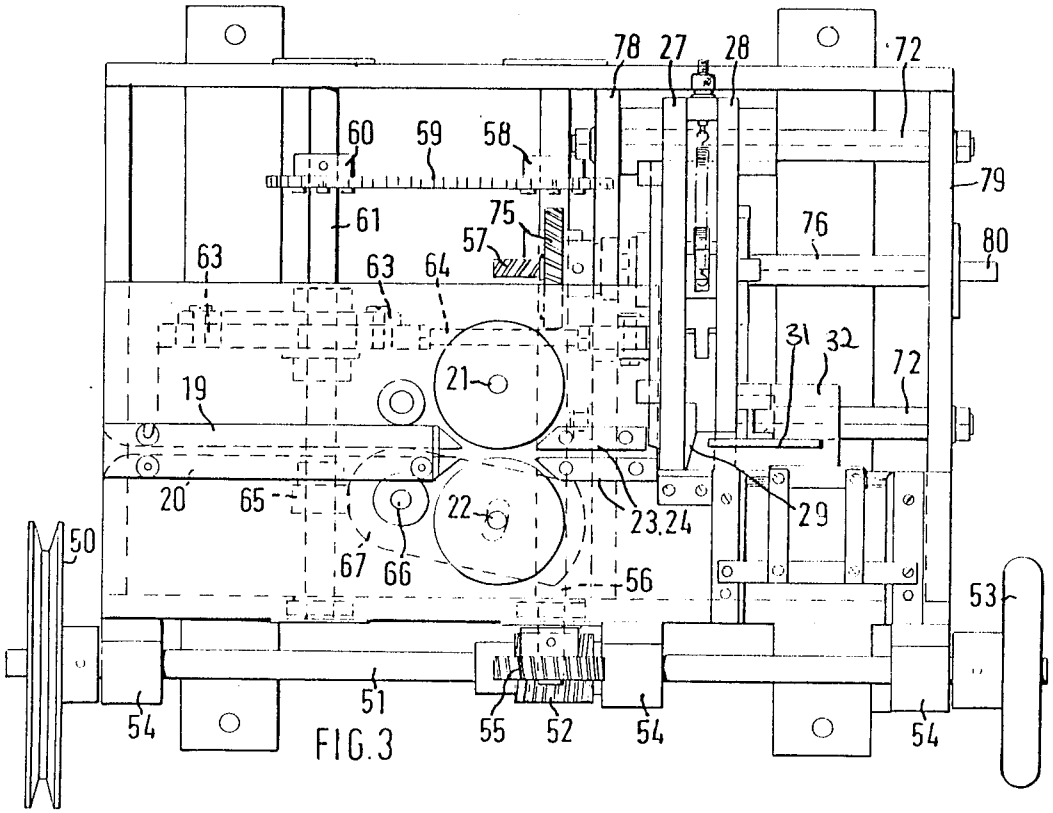
FIG. 3 is a plan view of a first embodiment of a drive and cutting unit according to the invention.
Figure 9:
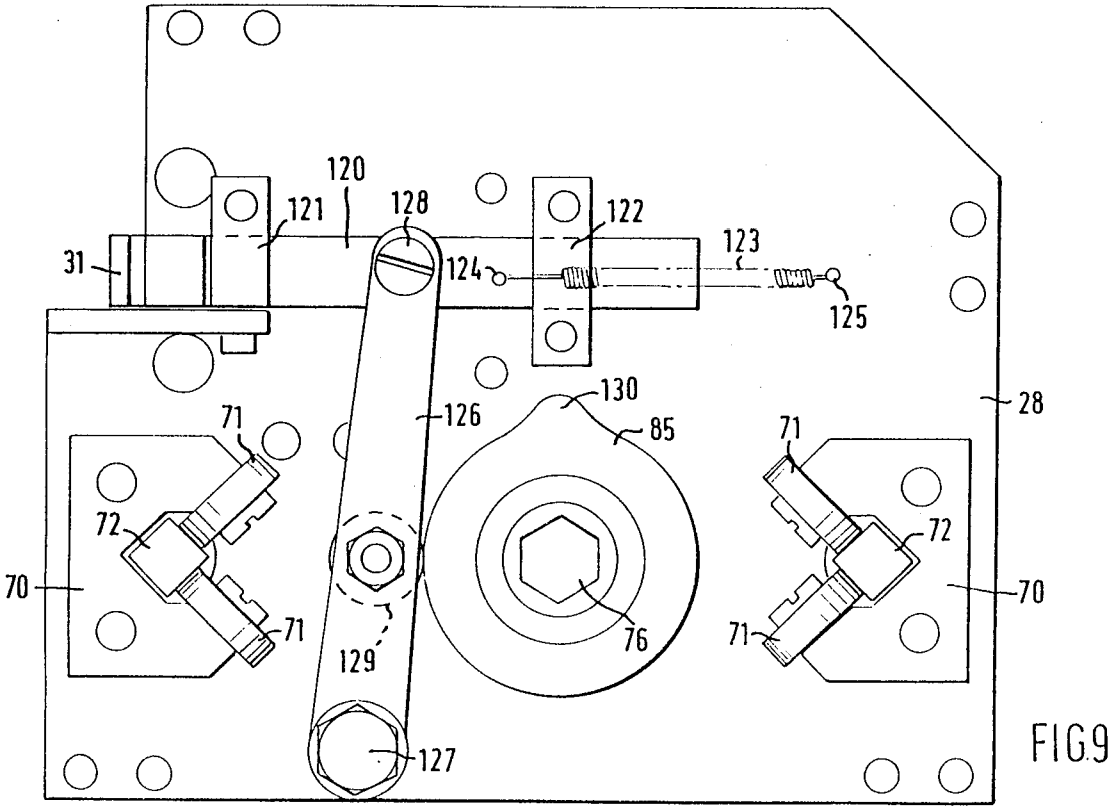
FIG. 9 is a view of the the trailing or downstream outer face of the cutting unit of the first embodiment, showing a cut booklet ejector mechanism.

The strand then enters a cutting unit 25 through an aperture 26 in a leading plate 27 which is closed off by means of a high calibre steel fixed die 30. The unit has a trailing plate 28 that is mounted in closely spaced parallel relationship to the plate 27. A knife 29 located between the plates 27, 28 has its cutting surface against the inner face of the die 30 and is mounted for shearing movement across the aperture (fixed outlet passage) 26 and back to sever booklets from the advancing booklet strand. The cutting unit 25 is mounted on linear bearings and is reciprocated by means of a constant velocity cam and follower arrangement so as to move upstream and downstream of the paper strand at the same speed as the paper strand advances. The upstream face of the leading plate 27 has a cam operated paper clamping mechanism. Thus the strand enters the aperture 26 while the unit 25 is moving upstream of the strand with the clamping mechanism in a disengaged position and with the knife 29 also retracted. The travel of the carriage 25 is, of course, half the length of a cut booklet. After the carriage return is complete, the clamping mechanism closes to hold the booklet strand against the die 30 and during the forward stroke the knife 29 is advanced in appropriately timed relationship to sever a booklet length from the strand. The downstream face of the place carries a pusher mechanism 31 operated by a cam to eject the cut booklet at the downstream extremity of the travel of the unit 25. Plates 27 and 28 of cutting unit 25 act to couple the knife 29 and pressure mechanism 31 so that they may operate in an appropriately timed manner during each recipication of the cutting station 25 to cut and eject the booklet in the appropriate sequence. The cut booklets rest atop a table 32 shown in FIGS. 3 and 9. Referring to FIG. 3 the table 32 is positioned above shaft 72 and below pusher mechanism 31. In FIG. 9 the table 32 is shown in elevation. The cut booklets are ejected by the pusher mechanism 31 in a plane normal to the line of advance of the booklet strand onto an endless belt conveyor 33 bounded by upstanding guides 33, 34 to hold the cut booklets in position thereon. An indexing mechanism 35 advances the conveyor 33 in booklet thickness increments so that newly cut booklets are accepted onto the conveyor 33 at the proper time. A retention bar 36 loaded by leaf springs 37 engages the edge of the last cut booklet as the cutting unit 25 returns so that the advance of the booklet strand into the cutting unit at the next stroke is not impeded by unwanted return of the last cut booklet or part thereof from the conveyor.

Figure 6:
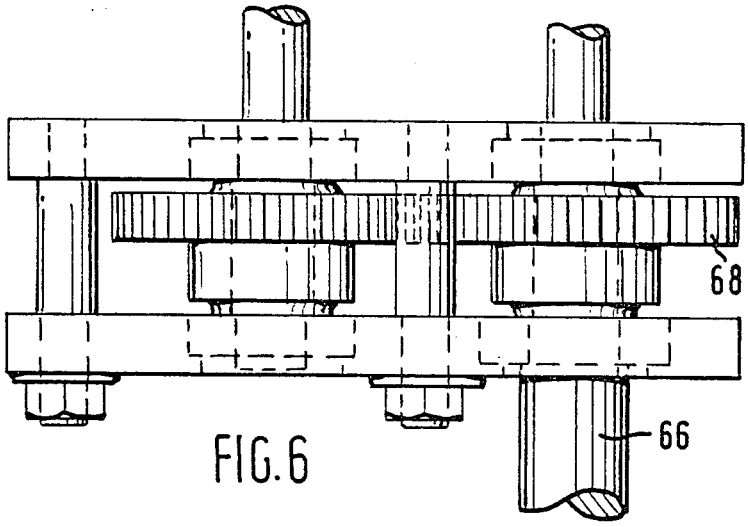
FIG. 6 is a fragmentary perspective view of a first embodiment drive and cutting unit according to the invention.
Figure 2:
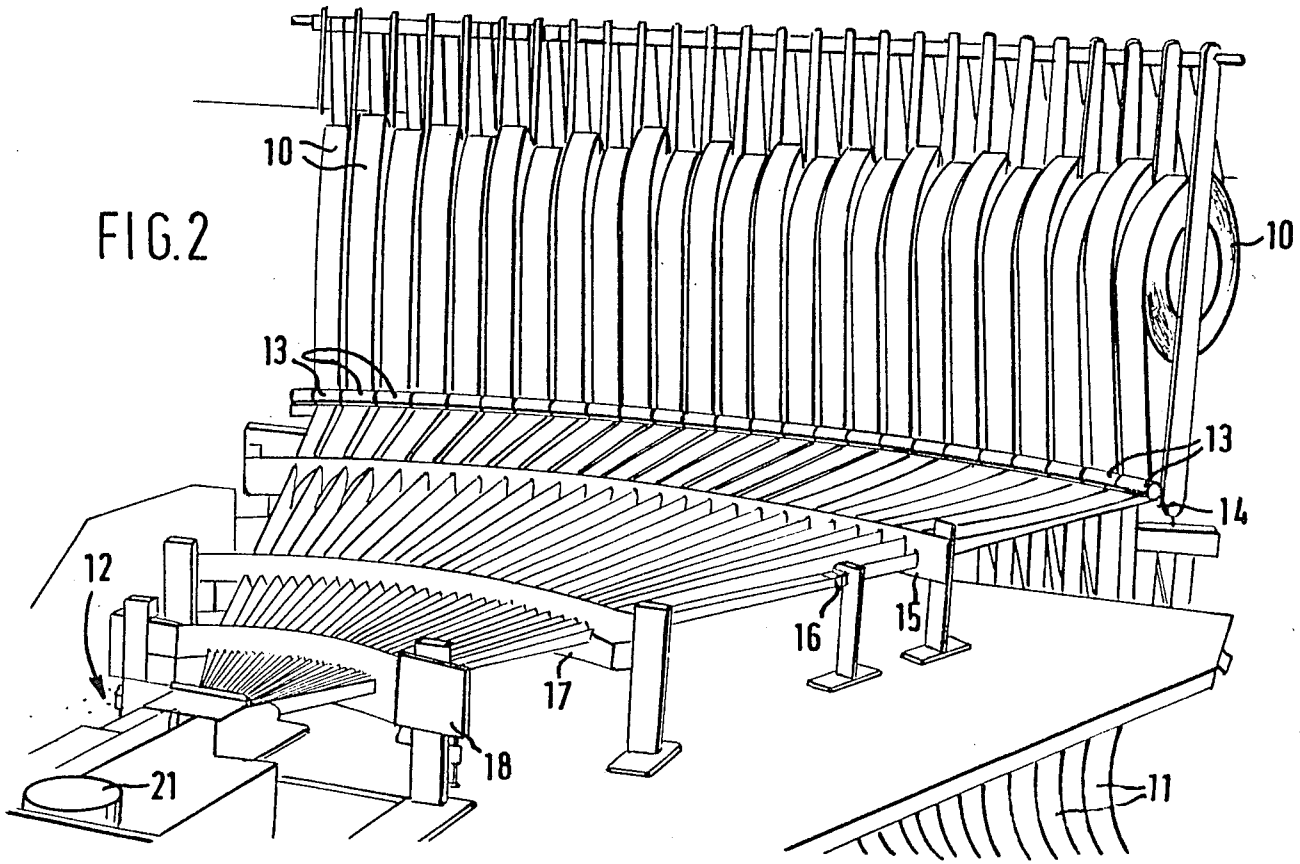
FIG. 2 is a view of the bobbin holder and interfolding part of the machine of FIG. 1.
Figure 4:
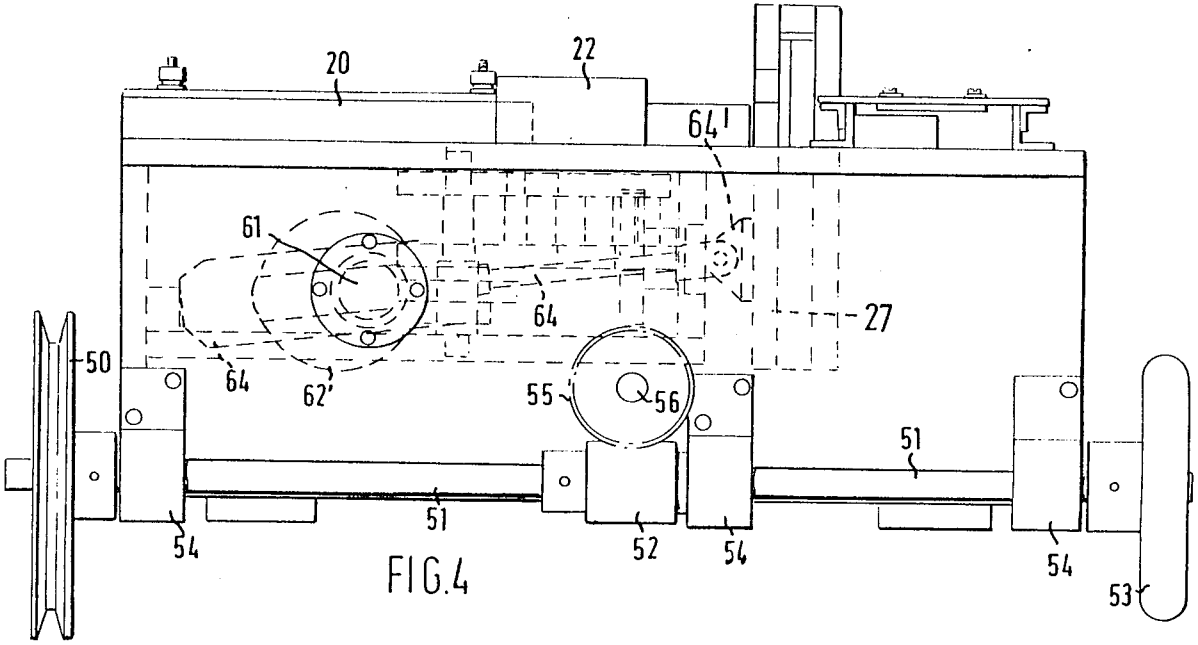
FIG. 4 is a side elevation view of a first embodiment of a drive and cutting unit according to the invention.
Figure 5:
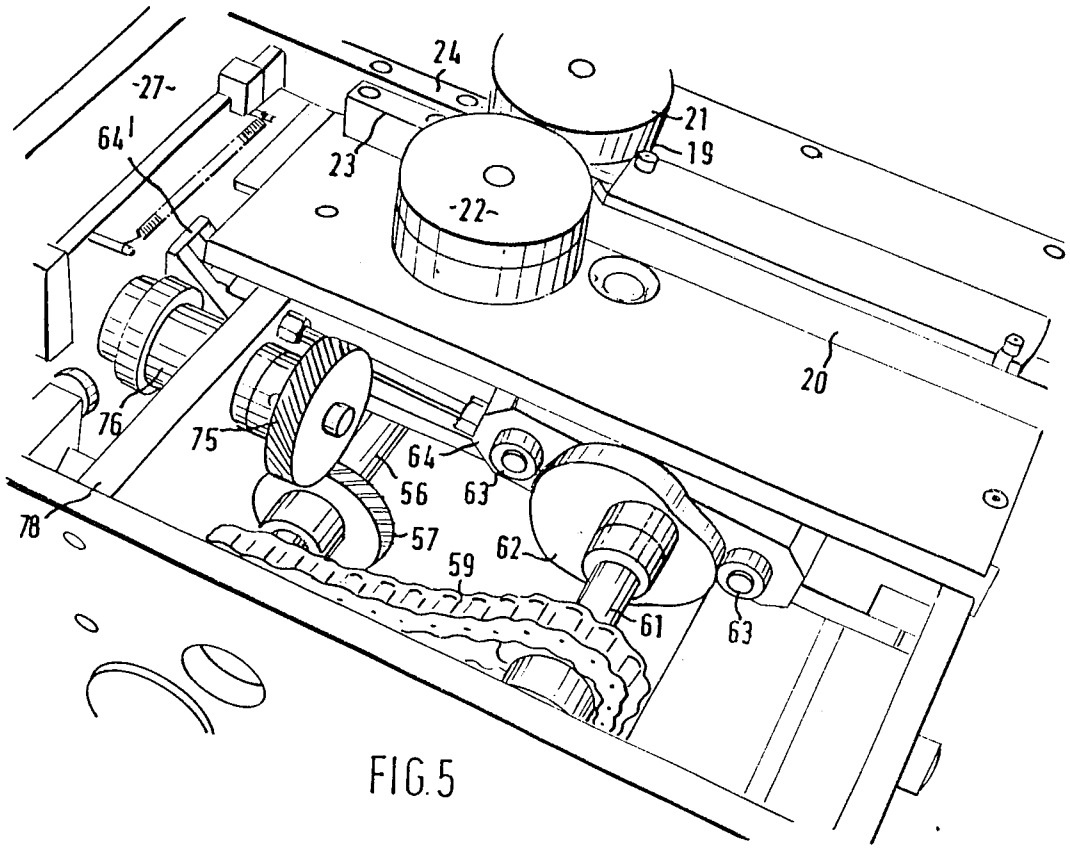
FIG. 5 is a view of a drive unit for pull-through rollers that is in turn driven from the drive unit of the first embodiment shown in FIG. 3.

A general arrangement of the drive unit is shown in FIGS. 3, 4 and 5. Power from a drive belt of an electric motor is transmitted via pulley wheel 50 to drive input shaft 51 that carries a worm 52 and a hand wheel 53, the shaft being supported for rotation in bearings 54. The worm 52 meshes with worm wheel 55 of a transverse shaft 56. the shaft 56 carries a helical gear 57 and a sprocket wheel 58. A chain 59 connects the sprocket wheel 58 with a further sprocket wheel 60 of a second transverse shaft 61 that drives the constant velocity cam and the pull-through rollers 21, 22. Attached to the shaft 61 is a generally heart-shaped cam 62 that provides a uniform motion to a follower assembly including a pair of follower rollers 63 that engage opposite sides of cam 62 and are carried in a uniform cam link 64 that is pivotally connected at 64' to the leading plate 27 of the cutting unit 25. The shaft 61 also carries a helical gear 65 that drives a vertical shaft 66 by means of a helical gear 67. At the upper end of shaft 66 is a straight spur gear 68 (FIG. 6) which in turn drives the two pull-through rollers 21, 22 by a series of interlocking gears.

Figure 8:
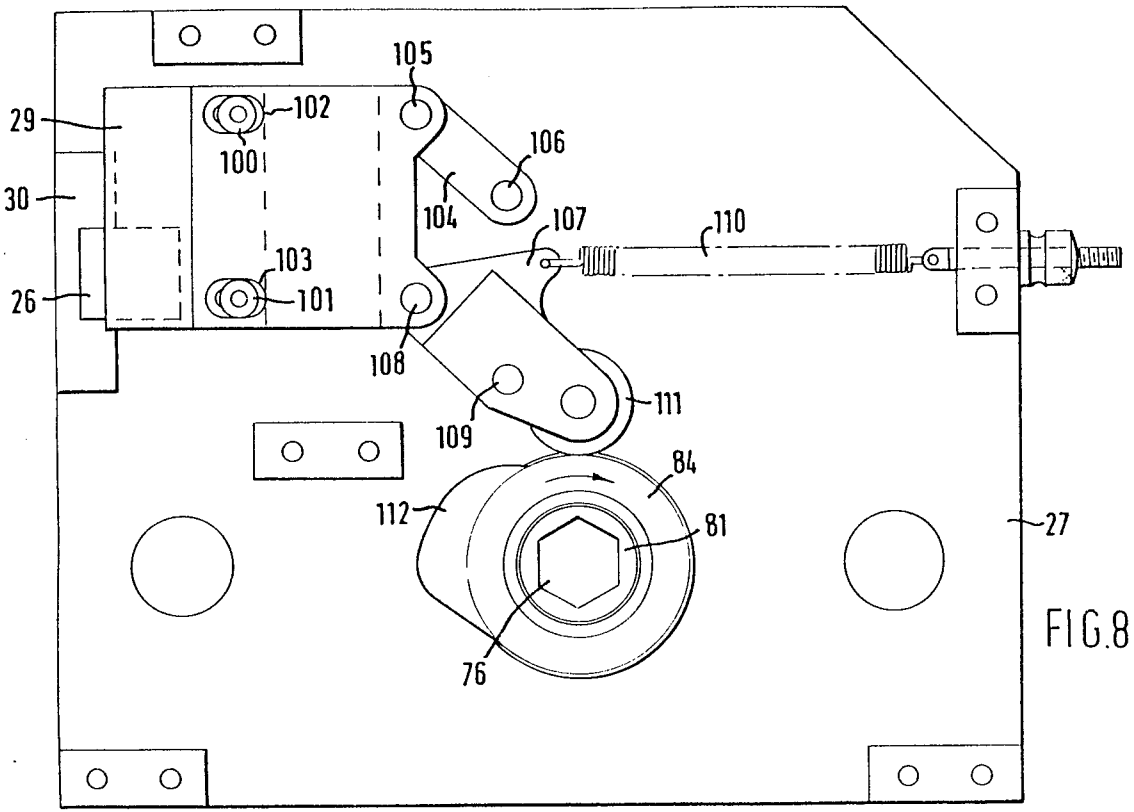
FIG. 8 is a view of the leading inner face of the cutting unit according to the first embodiment as shown in FIG. 3.
Figure 10:
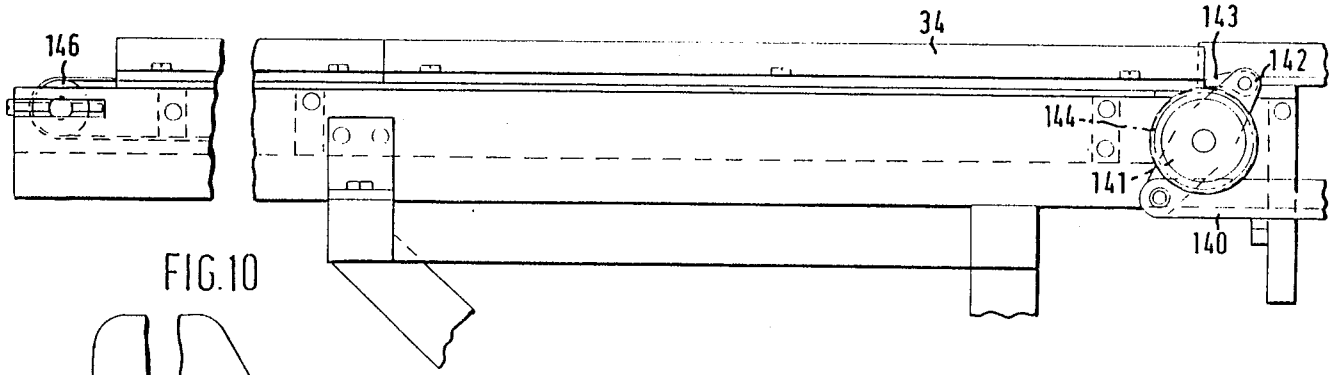
FIGS. 10 and 11 are side and plan views of an output conveyor that receives cut booklets from the cutting unit according to the first embodiment.
Figure 11:
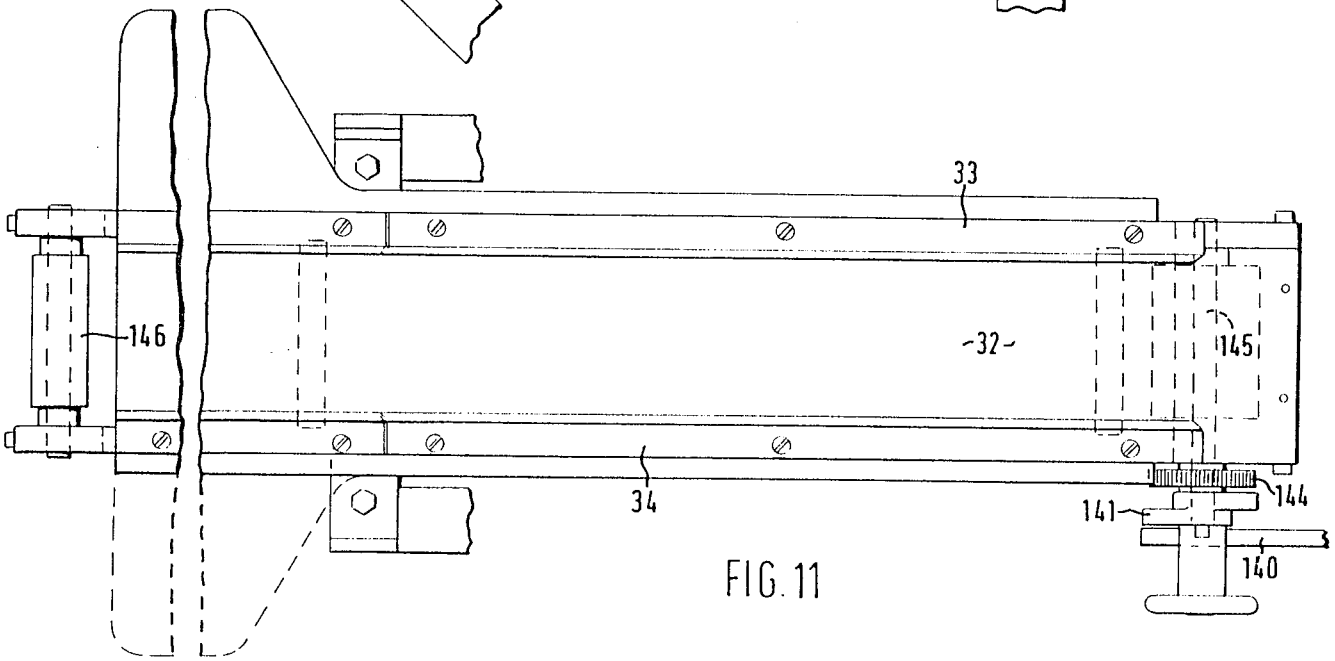

As more clearly seen in FIGS. 8, 9 and 10, the plates 27 and 28 carry four linear bearing carries 70 that carry pairs of bearing rollers 71 directed at 90° that each run on a pair of adjacent faces of rectangular bearing bars 72. The location of the bearing carriers 70 can be adjusted to give an accurate alignment of the plates 27, 28. The helical gear 57 on the transverse shaft 56 drives a helical drive gear 75 of a shaft 76 of hexagonal section that is supported in a fixed side plate 78 and in end plate 79 with its free end 80 projecting through the plate 79 to provide a drive for the belt conveyor described below. The shaft 76 passes through the plates 27, 28 and carries a sleeve 81 of hexagonal core profile and cylindrical external profile which is supported in ball bearings in leading and trailing plates 27, 28. The sleeve 81 carries on the outer face of the plate 27 a cam 82 for operating the clamping mechanism that has a raised lobe 83 that occupies 180° of rotation. Between the plates 27, 28 there is attached to the sleeve 81 a cam 84 that operates the cutting knife. Finally on the outer face of the plate 28 there is attached to the sleeve 81 a third cam 85 that operates the pusher mechanism. It will be noted that the lobe 130 of cam 85 occupies only a small angle.

Figure 7:
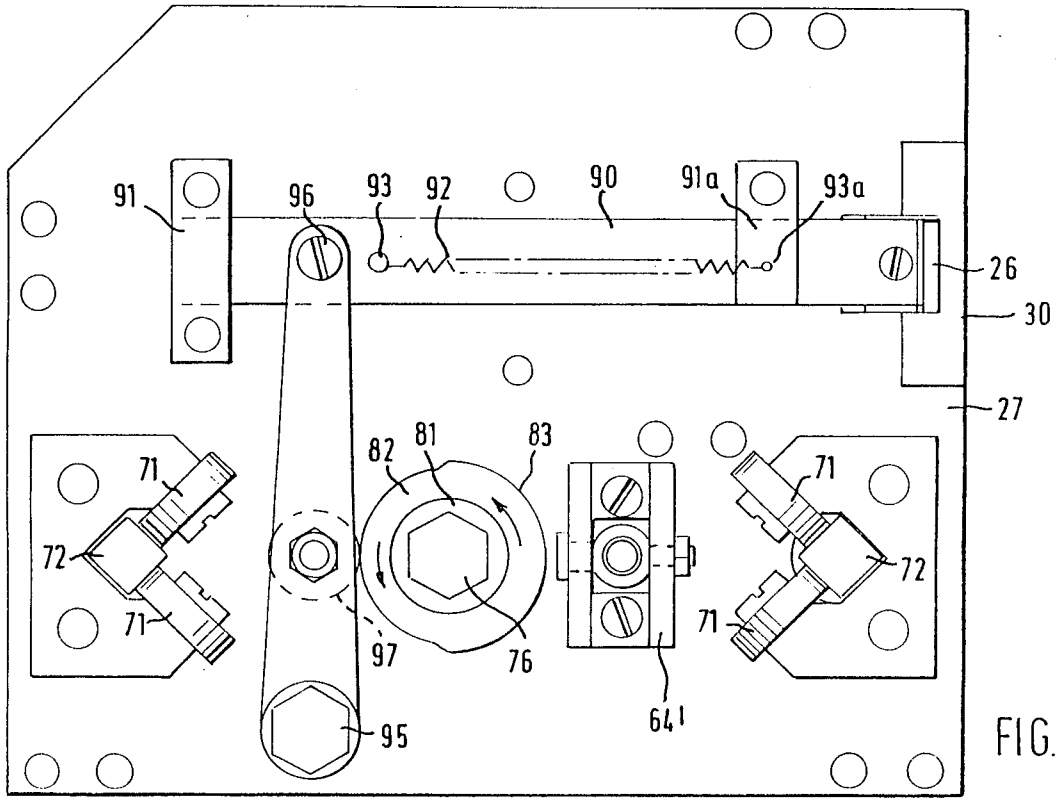
FIG. 7 is a view of the leading or upstream outer face of the cutting unit of the first embodiment as shown in FIG. 3.

In FIG. 7, the clamping mechanism comprises a clamping bar 90 on the outer face of the leading plate 27 and guided for movement towards and away from the aperture 26 by means of straps **91, 91*a*. A tension spring 92 between a pin 93*a* on the strap 91*a* nearer the aperture 26 and a pin 93 on the bar 90 urges the clamping bar 90 towards clamping engagement with the interfolded strand of paper entering the aperture 26, and the bar 90 is lifted from clamping engagement therewith by a link 94 pivoted to the plate 27 and to the bar 90 at pivots 95, 96 and having a follower roller 97 engaged with the cam 82 so that the bar 90 is retracted from engagement with the advancing interfolded strand while the follower roller 97 is on the raised sector 83. As will be apparent from the earlier description, this is timed to be when the cutting unit 25** is in the return half of its travel.

In FIG. 8, the knife 29 is held against the inner face of plate 27 by means of upper and lower studs that locate in oval slots to permit the knife 29 to travel towards and away from the slot 26. An upper line 104 is pivoted between the knife 29 and plate 27 at pivots 105, 106. A lower link 107 is pivoted at 108, 109 between the knife 29 and the plate 27, the pivots 108, 109 enabling the link 107 to move in parallel with the link 104. The link 107 is connected to tension spring 110 that returns the knife 29 away from the aperture 26 and also carries a follower roller 111 that engages raised sector 112 on the cam 84 to advance the knife 29 across the aperture 26, thereby serving the strand of interfolded papers that have passed therethrough. The motion of the blade of knife 29 has components both towards and across the strand. This type of motion is referred to as a "guillotine - like" movement. It will be noted that the follower 111 engages lobe 112 when follower 97 is free from sector 83 so that the cutting is timed to take place when the cutting unit is advancing with the interfolded paper strip clamped in position relative thereto.

The pusher mechanism which is on the outer face of the trailing plate 28 is shown in FIG. 9. The pusher 31 is carried by a bar 120 supported in straps 121, 122 for movement transversely of the interfolded paper strand and is urged away therefrom by tension spring between pin 124 on the bar 120 and pin 125 on the plate 28. An actuating lever 126 is pivoted to the plate 28 at 127 and to the bar 120 at 128 and carries a follower roller 129 that engages the cam 85. The roller 129 traverses lobe 130 on cam 85 to advance the pusher mechanism when the cutting unit 25 reaches the forward end of its travel, so that the cut strand is ejected onto the conveyor 32.

In order to drive the output conveyor 33 the free end 80 of the shaft 76 carries an eccentric pivoted to one end of link 140 whose oscillations are transmitted to one end of rachet lever 141 whose other end 142 carries a pawl 143 that engages a toothed drive wheel 144. The drive wheel 144 is connected to the shaft of a roller 145, which is one of a pair 145, 146 that support the endless belt conveyor 33. Thereby as the lever 141 is oscillated, the belt 33 is advanced stepwise in appropriate distance increments to accept cut booklets of interleaved paper.

Figure 14:
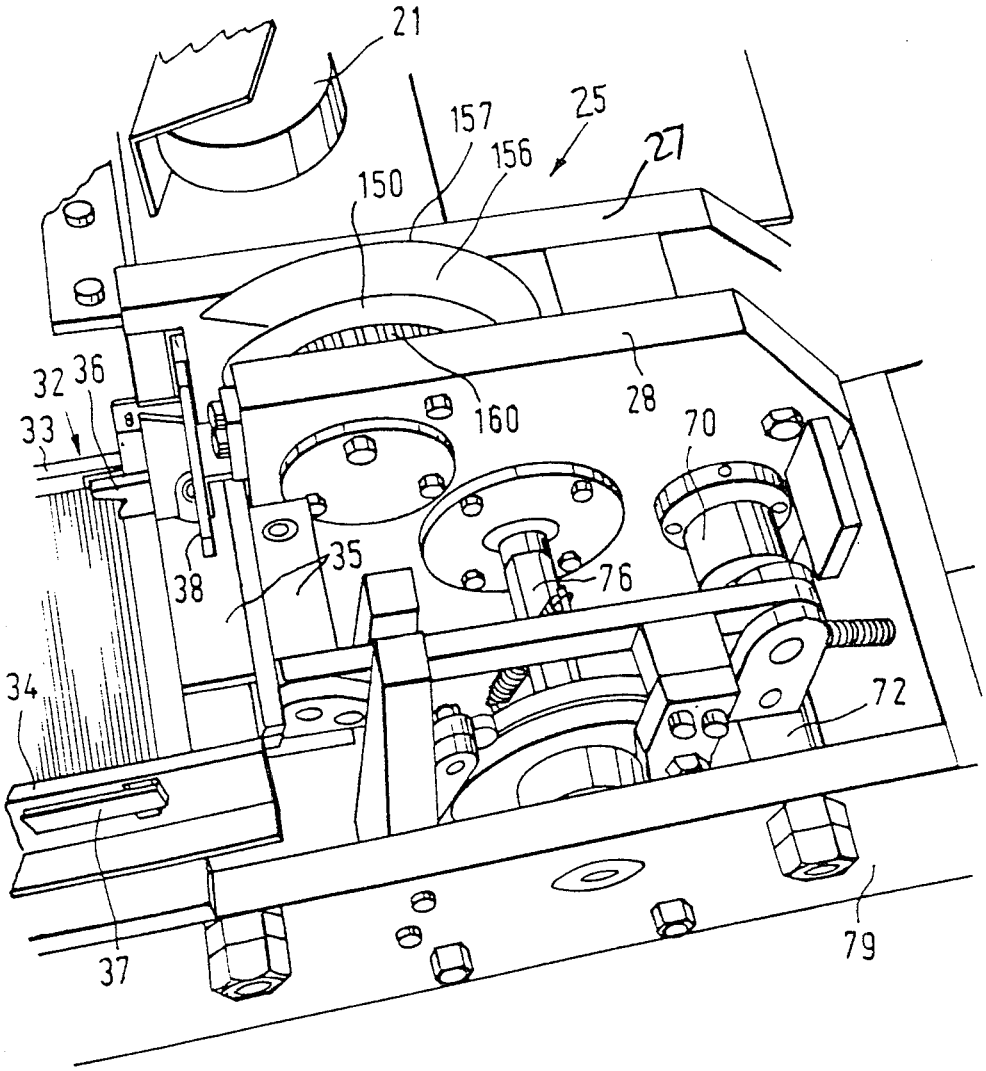
FIG. 14 is a fragmentary top perspective view of the drive and cutting unit of the second embodiment shown in FIG. 12.
Figure 15:
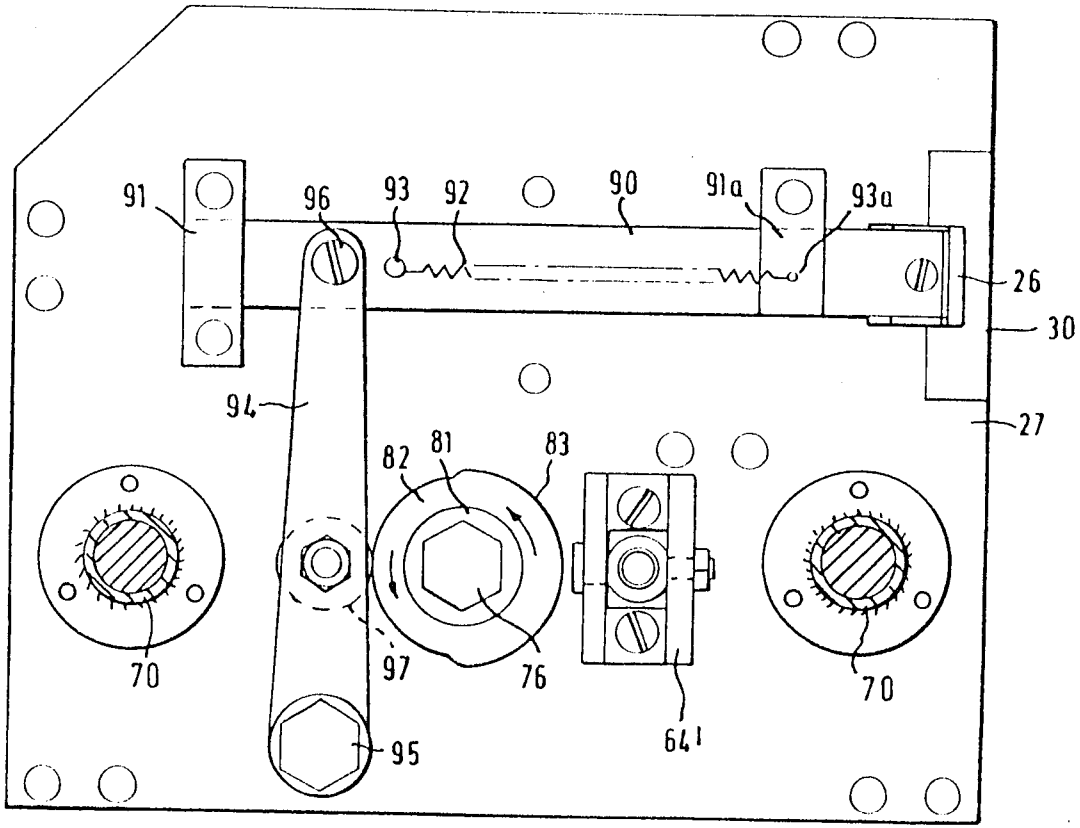
FIG. 15 is a view on the leading or upstream outer face of the cutting unit of the second embodiment shown in FIG. 12 showing a clamping mechanism.
Figure 16:
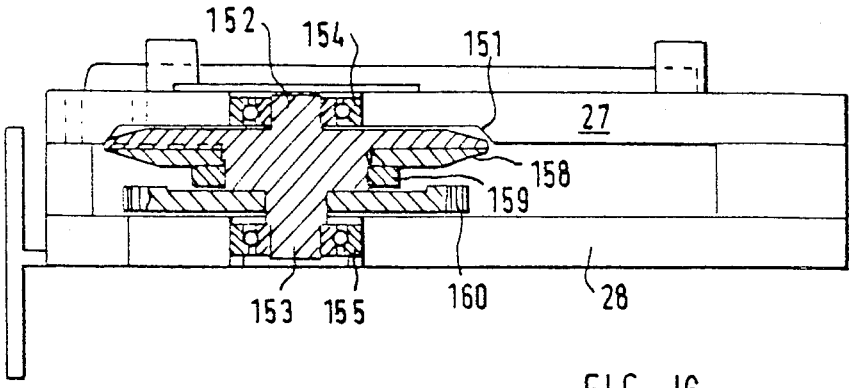
FIGS. 16 and 17 are respectively a partly sectional plan view and a view on the leading inner face of the cutting unit the second embodiment shown in of FIG. 12 showing the knife mechanism.
Figure 17:
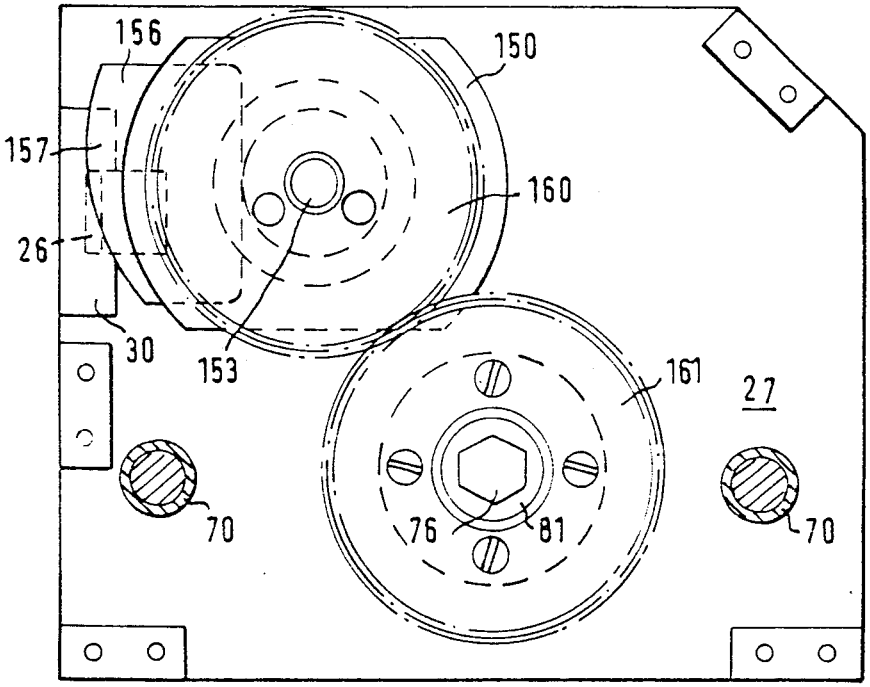

FIGS. 14, 16 and 17 illustrate a preferred alternative embodiment of the cutting unit and take the place of FIG. 8 above. A knife support 150 rotates in recess 151 in the inner face of leading plate 27 and is supported for rotation between the plates 27, 28 by stub shafts 152, 153 that are supported in rolling contact bearings 154, 155. The support 150 rotatably carries a knife 156 having a generally crescent-shaped cutting blade 157 that traverses the aperture 26 once per rotation of the support. This type of motion is referred to as a slicing movement. The blade 157 not only compresses the paper strip during cutting but also moves across it, thereby giving a highly effective cutting action with reduced cutting force required. The knife 156 is held to the support 150 by means of a clamping disc 158 which is held in place by a nut 159. The support 150 is rotated by means of drive gear 160 that is rotated by driven gear 161 which is rotated by the hexagonal shaft 76 and sleeve 81. The timing of the knife traverse of the aperture 26 is as described with reference to FIG. 8. The arrangement described has the advantage that it gives a better cutting action, uses only rotating parts rather than reciprocating parts and is constructionally simpler than the arrangement of FIG. 8. Furthermore the blade 157 may be arranged to traverse a sharpening stone at each revolution so that it is maintained sharp in service and only has to be replaced at infrequent intervals.

In this alternative preferred embodiment utilizing the rotary knife as described above, is described in detail below with reference to FIGS. 14, 16 and 17. Like numerals are used to identify like components previously described. Repeated description of same is omitted where unnecessary.

A knife 157 (FIGS. 14, 16 and 17) located between the plates 27, 28 has its cutting surface against the inner face of the die 30 and is mounted for slicing movement across the aperture 26 to sever booklets from the advancing booklet strand. The term "slicing movement" means that the knife 157 has components of motion both across the strand and through the thickness of the strand. The cutting unit 25 is mounted on linear bearings and is reciprocated by means of a constant velocity cam and follower arrangement so as to move downstream of the paper strand at the same speed as the paper strand advances and to return upstream.

The upstream face of the leading plate 27 has a cam operated paper clamping mechanism. Thus the strand enters the aperture 26 while the unit 25 is moving upstream of the strand with the clamping mechanism in a disengaged position and with the blade 157 clear of the aperture 26. The travel of the cutting unit 25 is, of course, half the length of a cut booklet. After the cutting unit return is complete, the clamping mechanism closes to hold the booklet strand against the die 30 and during the forward stroke the blade 157 is rotated so as to make a slicing movement across the aperture 26 in appropriately timed relationship to sever a booklet length from the strand.

Downstream of the plate 28 there is provided a separate fixed pusher mechanism 31 operated by cams to remove the cut booklet at the downstream extremity of the travel of the unit 25. Cut booklets are supported on table 32 (FIG. 14) that is mounted on and travels with the unit 25. The cut booklets are removed by the pusher mechanism 31 (FIG. 1) in a plane normal to the line of advance of the booklet strand onto a discharge chute 32 bounded by upstanding guides 33, 34 to hold the cut booklets in position thereon. The inlet ends 38 of guides 34 are formed with springs 37 that engage the ends of the last cut booklet as the cutting unit 25 returns so that the advance of the booklet strand into the cutting unit at the next stroke is not impeded by unwanted return of the last cut booklet or part thereof from the conveyor and control of the last cut booklet is not lost.

In the alternative embodiment of the invention, FIGS. 14 to 17, the plates 27 and 28 carry sleeves 70' that each run on a bearing rod 72' defining linear bearings for reciprocation of the cutting unit 25.

Referring again to FIG. 12, the helical gear 57 on the transverse shaft 56 drives a helical drive gear 75 of a shaft 76 of hexagonal section that is supported in a fixed transverse plate 78 and in end plate 79. The shaft 76 passes through apertures in the plates 27, 28 and carries a sleeve 81 of hexagonal core profile and cylindrical external profile which is supported in ball bearings in plates 27, 28. The sleeve 81 carries on the outer face of the plate 27 a cam 82 (FIG. 15) for operating the clamping mechanism that has a raised lobe 83 that occupies about 180° of rotation. The clamping mechanism comprises a clamping bar 90 on the outer face of the leading plate 27 and guided for movement towards and away from the aperture 26 by means of straps **91, 91*a*. A tension spring 92 between a pin 93*a* on the strap 91*a* nearer the aperture 26 and a pin 93 on the bar 90 urges the clamping bar 90 towards clamping engagement with the interfolded strand of paper entering the aperture 26, and the bar 90 is lifted from clamping engagement therewith by a link 94 pivoted to the plate 27 and to the bar 90 at pivots 95, 96 and having a follower roller 97 engaged with the cam 82 so that the bar 90 is lifted from engagement with the advancing interfolded strand while the follower roller 97 is on the raised sector 83. As will be apparent from the earlier description, this is timed to be when the cutting unit 25** is in the return half of its travel.

FIGS. 16 and 17 show the cutting function. A knife support 150 rotates in recess 151 in the inner face of leading plate 27 and is supported for rotation between the plates 27, 28 by stub shafts 152, 153 that are supported in rolling contact bearings 154, 155. The support 150 rotatably carries a knife 156 having a generally crescent-shaped cutting blade 157 that traverses the aperture 26 once per rotation of the support. The blade 157 not only compresses the paper strip during cutting but also moves across it, thereby giving a highly effective slicing action with low force required. The knife 156 is held to the support 150 by means of a clamping disc 158 which is held in place by a nut 159. The support 150 is rotated by means of drive gear 160 that is rotated by driven gear 161 which is rotated by the hexagonal shaft 76. The timing of the knife traverse of the aperture 26 is such that the unit 25 is advancing with the interfolded paper strip clamped in position relative thereto. Furthermore the blade 157 may be arranged to traverse a sharpening stone at each revolution so that it is maintained sharp in service and only has to be replaced at infrequent intervals. The cut booklets of paper are supported by the table 32 and are controlled by T-shaped guide bar 39 mounted on the station 25 downstream of the aperture 26 a short distance above the table 32. The guide bar 39 prevents paper from entering the space between plates 27, 28 and ensures that it takes a straight path towards the downstream end of the table 32.

Figure 12:
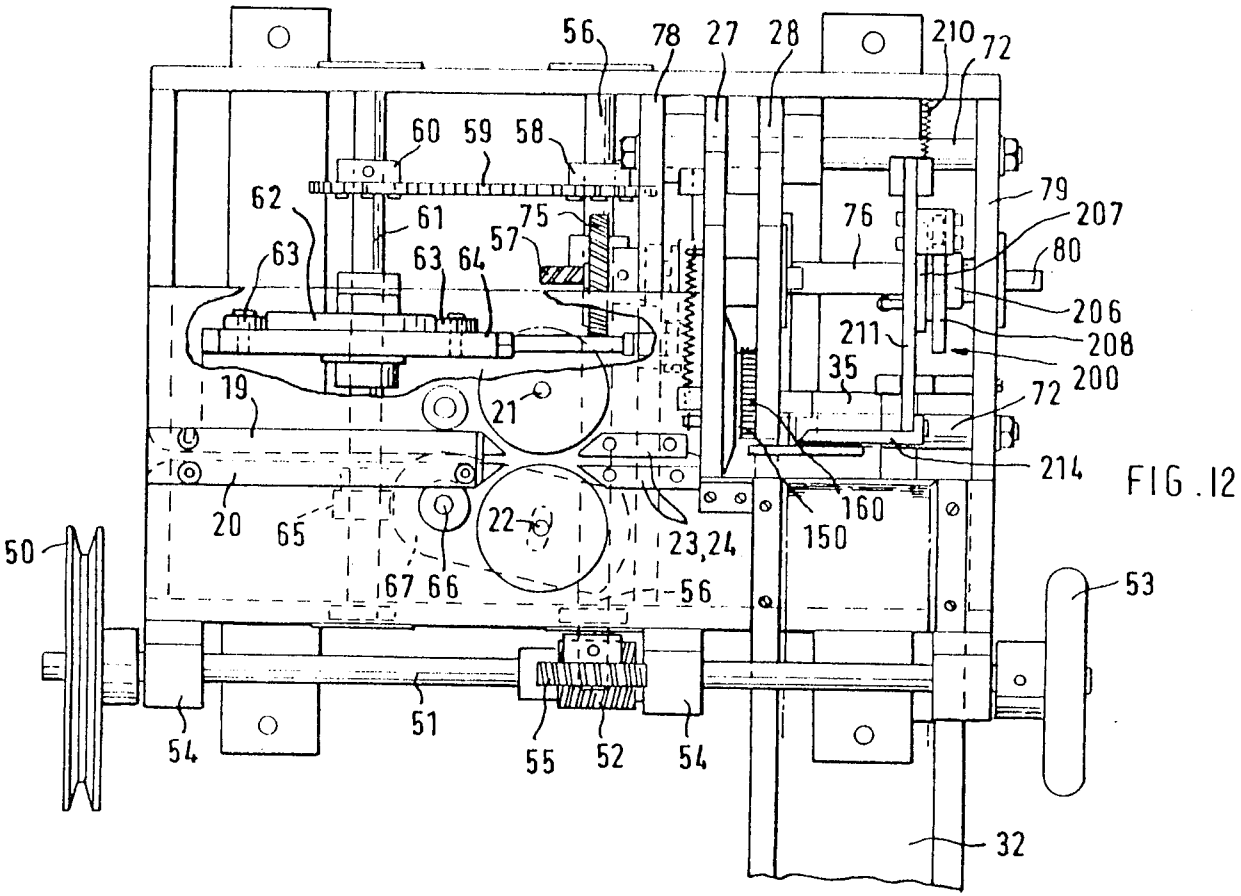
FIG. 12 is a plan of a second embodiment of a drive and cutting unit according to the invention.
Figure 13:
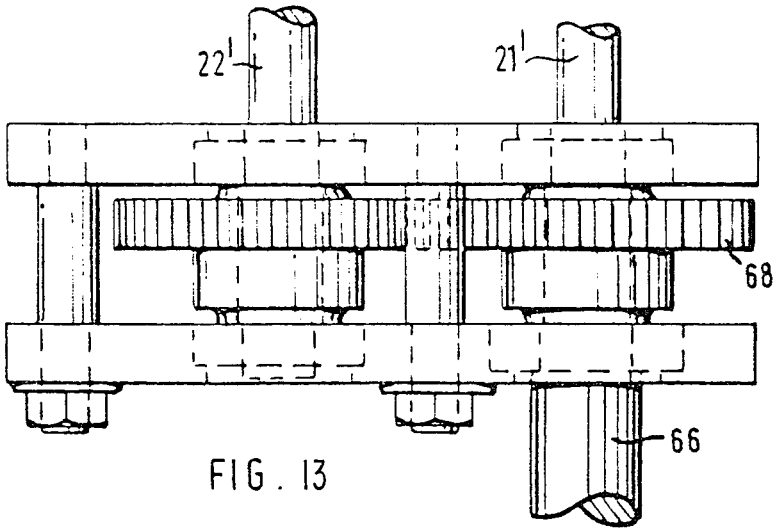
FIG. 13 is a view of a drive unit for pull-through rollers that is in turn driven from the drive unit according to the second embodiment shown in FIG. 12.
Figure 18:
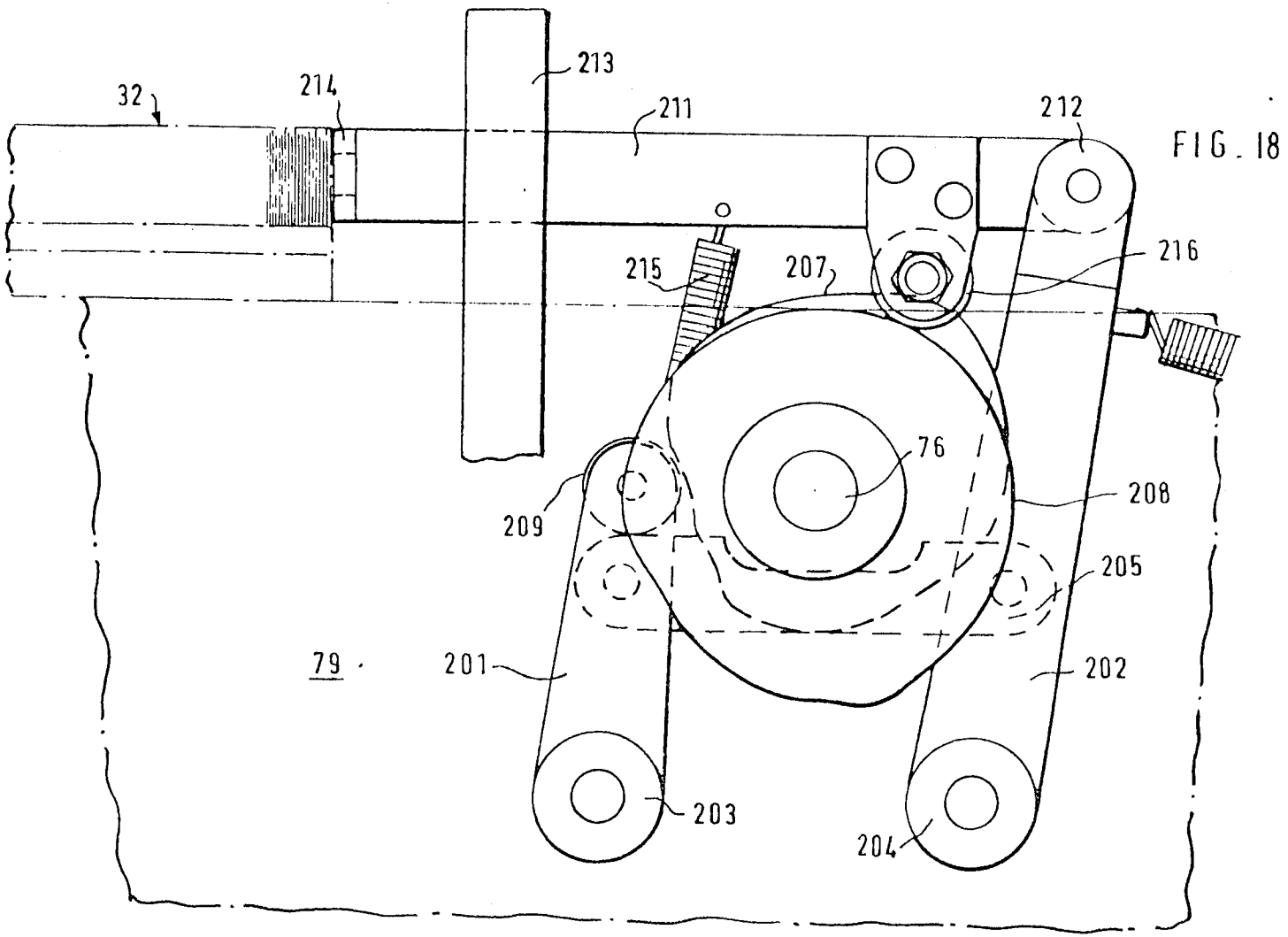
FIGS. 18 and 19 are fragmentary side and end views showing the ejector mechanism of the unit of FIG. 12.
Figure 19:
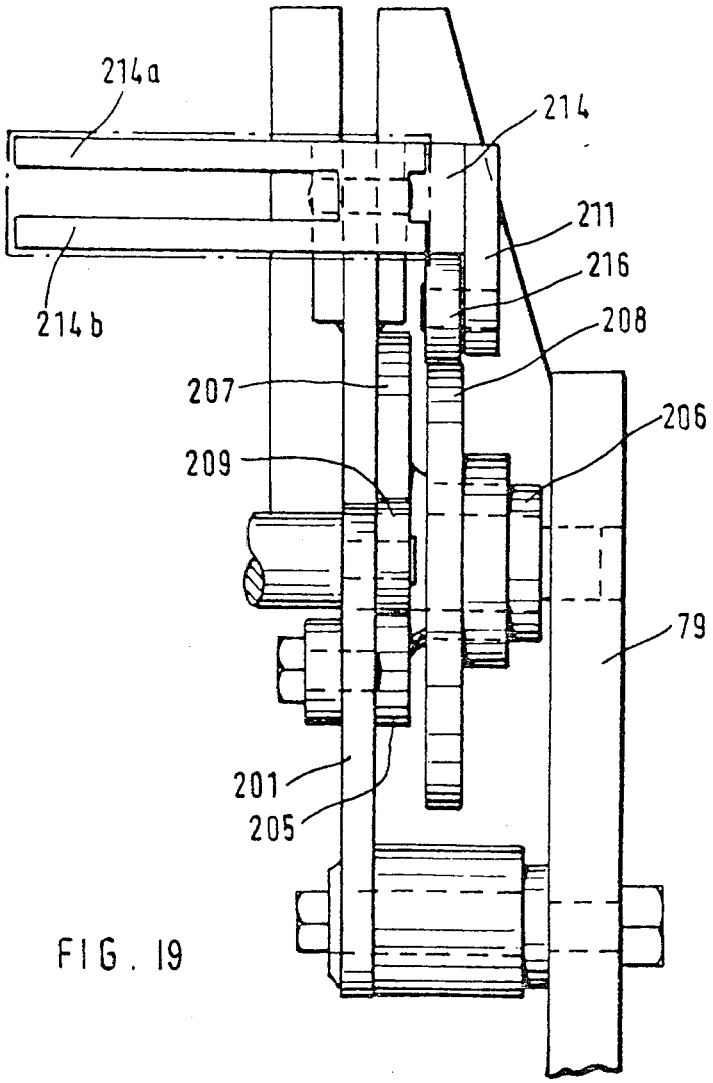
Figure 20:
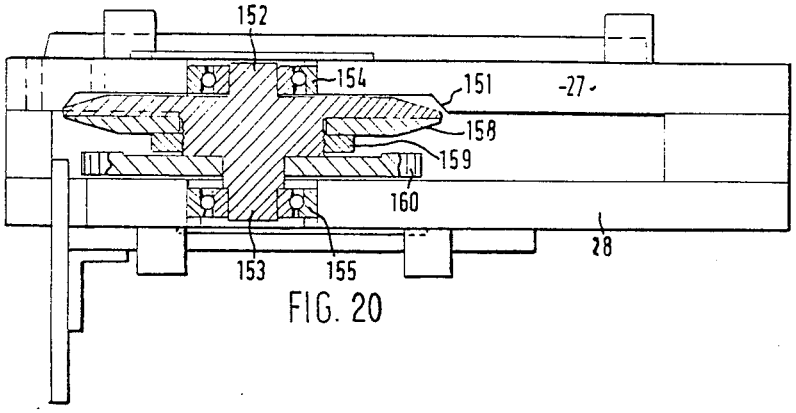
FIGS. 20 and 21 are plan and cross-sectional views of a cutting unit according to a third embodiment of the invention.
Figure 21:
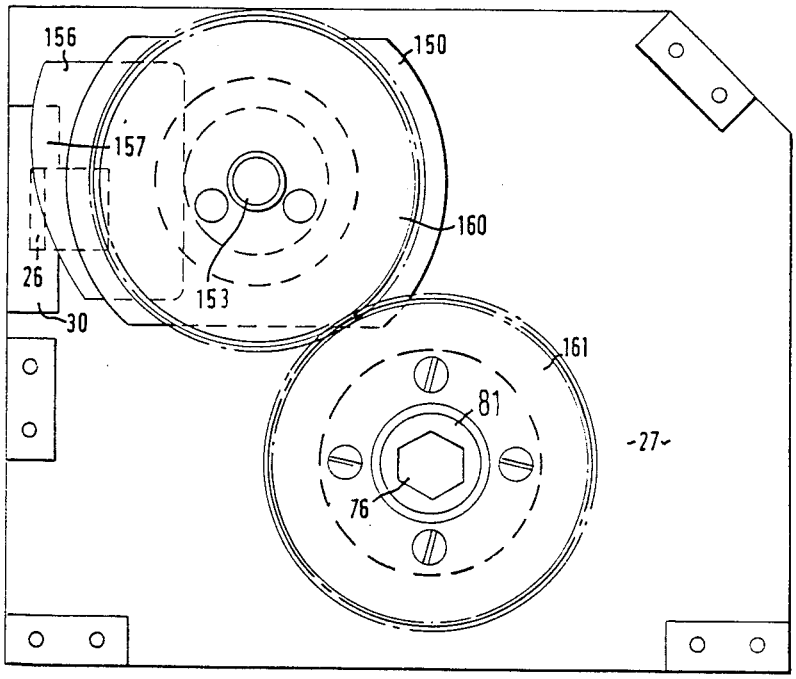

Referring to FIGS. 12, 18 and 19, the alternative embodiment of the invention includes an ejection station 200 fixed opposite to the discharge chute 33' rather than being carried by the station 25 as in the the first embodiment. A pair of links 201, 202 are pivoted at 203, 204 to the inner face of end plate 79 and are connected by tie bar 205 to form a parallel linkage. The shaft 76 has a second sleeve 206 carrying first and second cams 207 and 208. The link 201 which is close to discharge chute 33' is relatively short and has at its top end a follower roller 209 for the cam 207. The link 202 is connected adjacent its upper end to a tension spring 210 by which the links 201, 202 are biased away from the chute 33' so that follower roller 209 is maintained in contact with the surface of the cam 207. Ejector bar 211 is pivoted at 212 to the upper end of link 202, passes through a slotted plastics guide 213 and has at its tip a thrust plate 214 which is divided at the end which faces aperture 26 into upper and lower furcations **214*a*, 214*b*. The bar 211 is biased downwardly by tension spring 215 to maintain a follower roller 216 in contact with the surface of the roller 208. Accordingly as shaft 76 rotates there are two independent components of motion, firstly in a generally back and forward direction via cam 207 and follower 209 and secondly in a rise and fall direction via cam 208 and follower 216**.

The ability to lift the thrust plate 214 permits the entire cut booklet to be supported by the ejector. In the first embodiment the ejector was carried on the outer face of the plate 28 and was movable only in translation. Even though the ejection station operated within only a small angle of rotation of the shaft 76, by the time that the ejector begins to return, an appreciable length of new booklet material has entered the cutting station 25. To avoid the ejector fouling this new material it was made only about 70% of the width of a cut booklet. The unsupported upstream end of the cut booklet could not always be correctly engaged behind an inlet spring at the entrance to chute 33' but might return and foul incoming paper, causing a jam and consequent machine downtime. Such downtime is avoided by the independent movements provided via cams 207, 208. Forward movement of the thrust plate 214 occurs along a substantially straight path aligned with the chute 33', so that the guide bar 39 passes between furcations **214*a*, 214*b* of the plate 214 which thrusts the cut booklets from the table 32 (FIG. 12) into the chute 33' so that both its ends are retained behind springs 37 (FIG. 14). Before the return stroke has proceeded appreciably the head 214 is lifted by cam 208 and follower 216 clear of the guide bar 39 and of the path of new booklet strand entering the cutting station 25, and the head 214 does not fall significantly until it has passed behind guide bar 39. Consequently head 214 follows a looped path clear of incoming booklets. Such a complex motion would be difficult to provide if the ejection station 200 were on the cutting station 25 because the dwell of the station 25 at the downstream end of its travel in register with chute 33' is very brief. By contrast the operative sectors of cams 207, 208 are very broad, typically 90° in extent and have gently sloping flanks so that timing is easier having regard to the response time of the links 201, 202, 205, 211 and springs 210, 215** and operating forces and wear are reduced.

It will be appreciated that various modifications may be made to the embodiments described above without departing from the invention, the scope of which is defined in the appended claims.

I claim:

1. A machine for forming booklets of paper, comprising:

a plurality of sources of paper strip;

forming means for converging paper strips from the several sources into a single strand;

means for advancing the strand in a first direction;

a cutting unit for reciprocably moving along the strand so that a booklet length of the strand enters the cutting unit while the cutting unit returns counter to the first direction; said cutting unit including a knife for severing the booklet length from the strand while the cutting unit moves with the strand in the first direction;

an ejector unit for receiving cut booklets from said cutting unit when the cutting unit is towards the end of its travel in the first direction;

an outlet passage having a fixedly positioned entrance for receiving said cut booklets from said ejector unit;

said ejector unit being further operable for thrusting said cut booklets into said outlet passage, said ejector unit being fixedly positioned opposite said outlet passage entrance and having a thrust plate movable through a stroke towards said outlet passage to push a cut booklet into said outlet passage; and means operatively connecting the cutting unit and the ejector unit so that the stroke of the thrust plate occurs in a predetermined timed manner with respect to the reciprocation of the cutting unit.

2. A machine according to claim 1, wherein the outlet passage has a spring biased lever means at its entrance for preventing the booklets from returning to the ejector unit; and wherein the ejector unit thrust plate extends substantially the full width of the outlet passage.

3. A machine according to claim 2, further comprising a rotating shaft passing through the ejector unit, the thrust plate being operatively connected by a first coupling means to the rotating shaft for sequentially imparting a forward and reverse movement to the thrust plate and operatively connected by a second coupling means to the rotating shaft for sequentially imparting a rise and fall movement to the thrust plate, said movement being timed so that the thrust plate advances in the direction of the outlet passage, rises above the path of the strand, returns and then falls.

4. A machine according to claim 3, wherein the machine includes a wall leading to the outlet passage, first and second links pivoted to the wall for rotation in a plane generally parallel to the outlet passage, a third link connecting the first and second links to form a parallelogram linkage, the first link being relatively short and nearer the outlet passage a first cam on the rotating shaft being coupled to the first link by means including a follower at the end of the first link to effect the forward and reverse movement, the second link being relatively long and having pivoted thereto a fourth link carrying a thrust plate at its tip, a second cam on the rotating shaft being coupled to the second link by means including a follower partway along the second link to effect the rise and fall movement.

5. A machine according to claim 4, wherein the thrust plate is bifurcated to define a pair of vertically spaced tines facing the cutting unit, and the cutting unit carries a paper guide that passes between the tines as the cutting unit approaches the end of its travel in the first direction, said paper guide defining a linear path for the paper strand downstream of the cutting unit.

6. A machine according to claim 5, wherein the stroke of the thrust plate occupies about half the period of reciprocation of the cutting unit.

7. A machine according to claim 3, wherein, the rotating shaft is of non-circular cross-section and extends through said cutting unit parallel to the first direction, and further comprising a knife coupling means for translating rotational movement of the rotating shaft into rotational slicing movement of said knife across the strand in a plane substantially perpendicular to the first direction, the path of the knife and the path of the thrust plate being mutually independent.

8. A machine according to claim 7, wherein the knife has a generally crescent-shaped blade.

9. A machine according to claim 7, wherein the rotating shaft is a polygon in cross-section and tubular sleeve means on the rotating shaft operably couples the knife to the rotating shaft.

10. A machine according to claim 9, further comprising a strand clamping member disposed on the cutting unit and disengaging cam means disposed on the tubular sleeve for disengaging the clamping member when the cutting unit moves counter to said first direction.

11. A machine according to claim 2, wherein the ejector means is operated by a means for guiding the ejector means to travel from said first position, along the direction of the outlet passage, above the path of the strand, and back to said first position.

12. A machine according to claim 1, further comprising a driven shaft oriented normal to the first direction and having a constant velocity cam and a follower mounted thereon, the cutting unit being connected by means of a pivoted link to the follower of the constant velocity cam.

13. A machine according to claim 1, wherein the converging means comprises means for folding and interleaving the paper strips in a zig-zag configuration.

14. A machine for forming booklets of paper, comprising:

a plurality of roller means for continuously providing strips of paper; former means for converging paper strips withdrawn from said roller means into a single strand;

means for advancing the strand in a first direction; a cutting station means for reciprocably moving along the strand whereby a booklet length of the strand enters said cutting station means while said cutting station means moves counter to the strand in a second direction opposite to the first direction; a rotating shaft of non-circular cross-section extending through the cutting station means and directed parallel to said first direction; a clamping means disposed in said cutting station means for clamping the strand at the upstream end of the cutting station means while the cutting station means moves alongside the strand in the first direction;

knife means disposed in the cutting station means for cutting a booklet from the strand while said cutting station means moves alongside the strand in the first direction;

a tubular sleeve slideably mounted on said shaft and operably connected to the cutting station means, reciprocal movement of said cutting station means causing said sleeve to slide in an axial direction along said shaft and rotation of said shaft causing said sleeve to rotate; a clamp coupling means for coupling said clamping means to said sleeve and comprising a linking means for translating rotational movement of said sleeve into longitudinal movement of said clamping means; and a knife coupling means for coupling said knife means to said rotating sleeve, said knife coupling means comprising gear train means for translating rotational movement of said sleeve into a rotational slicing movement of said knife means across the strand in a plane substantially perpendicular to said first direction.

15. A machine according to claim 14, wherein the clamping means includes a strand clamping member disposed on said cutting station and a disengaging cam means disposed on said tubular sleeve for disengaging said clamping member when said cutting station is moving in said second direction

* * * * *